United States Patent [19]

Cadle et al.

[11] 4,274,875

[45] Jun. 23, 1981

[54] POWDER METALLURGY PROCESS AND PRODUCT

[75] Inventors: Terence M. Cadle, Coventry; Martyn S. Lane, Nuneaton, both of England

[73] Assignee: Brico Engineering Limited, Coventry, Great Britain

[21] Appl. No.: 926,038

[22] Filed: Jul. 19, 1978

[30] Foreign Application Priority Data

Jul. 20, 1977 [GB] United Kingdom ..... 30361/77

[51] Int. Cl.[3] ..... B22F 3/00

[52] U.S. Cl. ..... 75/232; 75/200; 75/206; 75/233

[58] Field of Search ..... 75/206, 200, 232, 233

[56] References Cited

U.S. PATENT DOCUMENTS

| | | | |
|---|---|---|---|
| 3,817,719 | 6/1974 | Schilke et al. | 75/206 |
| 3,879,831 | 4/1975 | Rigney et al. | 415/174 |

*Primary Examiner*—Brooks H. Hunt

*Attorney, Agent, or Firm*—Mawhinney & Mawhinney & Connors

[57] ABSTRACT

The invention consists of a process for the production of articles by powder metallurgy including the step of adding powdered mica to the metal powder before compacting and sintering. It also extends to a sintered metal product containing mica, in particular a valve seat insert and a shock absorber piston ring. The quantity of mica is preferably between 0.5% and 2% by weight of the metal.

4 Claims, 5 Drawing Figures

POWDER METALLURGY PROCESS AND PRODUCT

This invention relates to the process of producing articles by powder metallurgy, and to articles so produced.

The process essentially comprises the steps of compacting a metal powder of the desired composition to produce a handleable preform, and subjecting the preform to an elevated temperature in a controlled atmosphere for sufficient time to result in a coherent sintered article on cooling.

The process may include other optional steps, including repressing of the sintered article, heat-treatment of the article, and infiltration of the porosity of the article with another metal such as copper. The infiltration may be carried out on the sintered article, or simultaneously with the heating of the preform so that sintering and infiltration take place at the same time.

Examples of the process and resulting product are described in U.S. Pat. Nos. 3,694,173 and 3,829,295 and in co-pending application Ser. No. 414,953.

To reduce friction during the step of compacting the powder, a number of substances have been added in small quantity, e.g. 1 per cent; such substances have included powdered graphite, zinc stearate and lithium stearate. The majority of the known substances added as lubricants are thermally unstable, and at the elevated temperature of the sintering process they react chemically, often releasing fumes which contaminate the furnace atmosphere. Sometimes the lubricant must be burnt off prior to sintering.

According to one aspect of the present invention, a process for the production of articles by powder metallurgy, includes the step of adding powdered mica to the metal powder before compacting and sintering.

Preferably the powdered mica is added in the amount of between 0.5% and 2% by weight.

According to another aspect of the present invention there is provided a sintered metal product containing mica.

Preferably the component contains between 0.5% and 2% of mica by weight.

Figure 1:
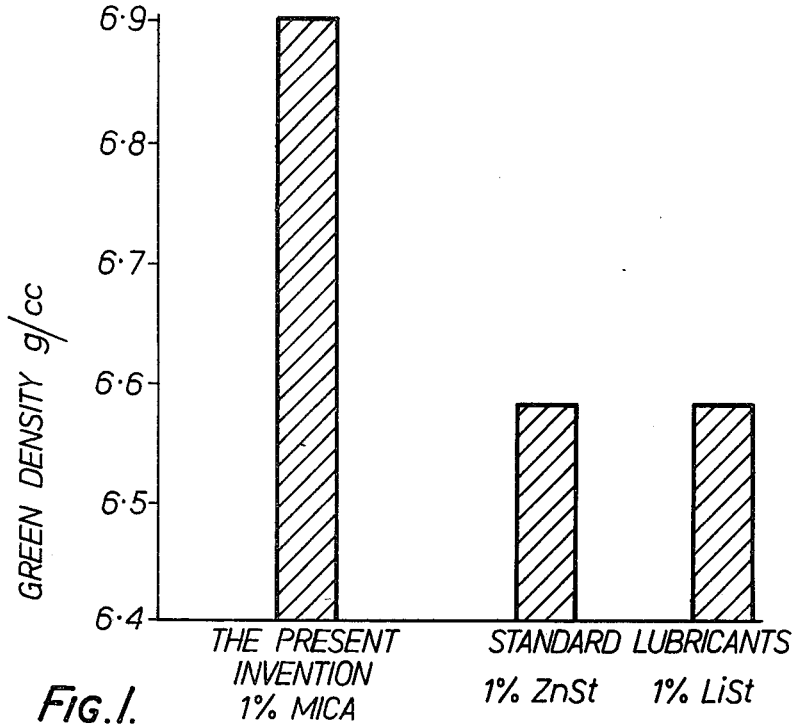
Figure 2:
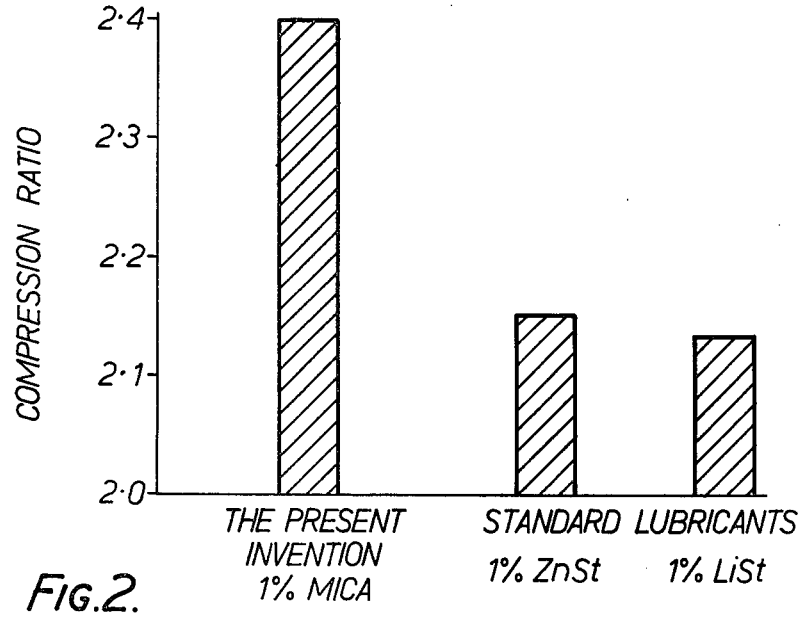
Figure 3:
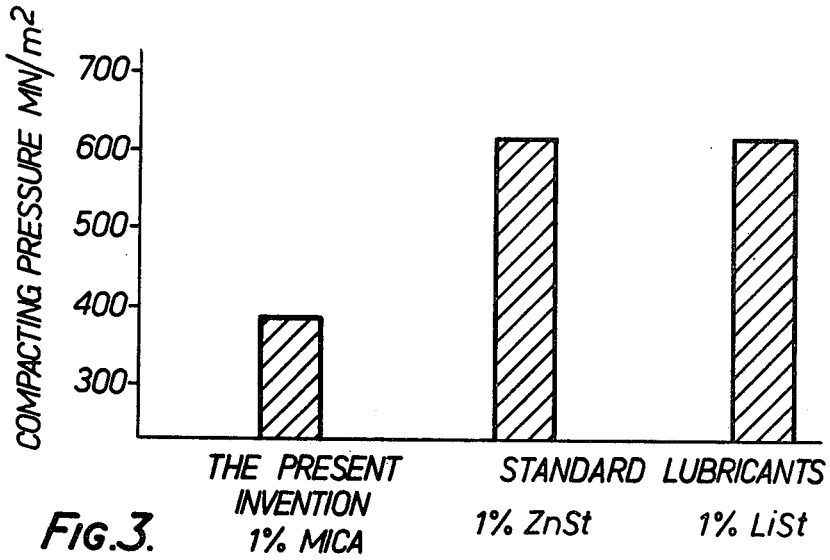
Figure 4:
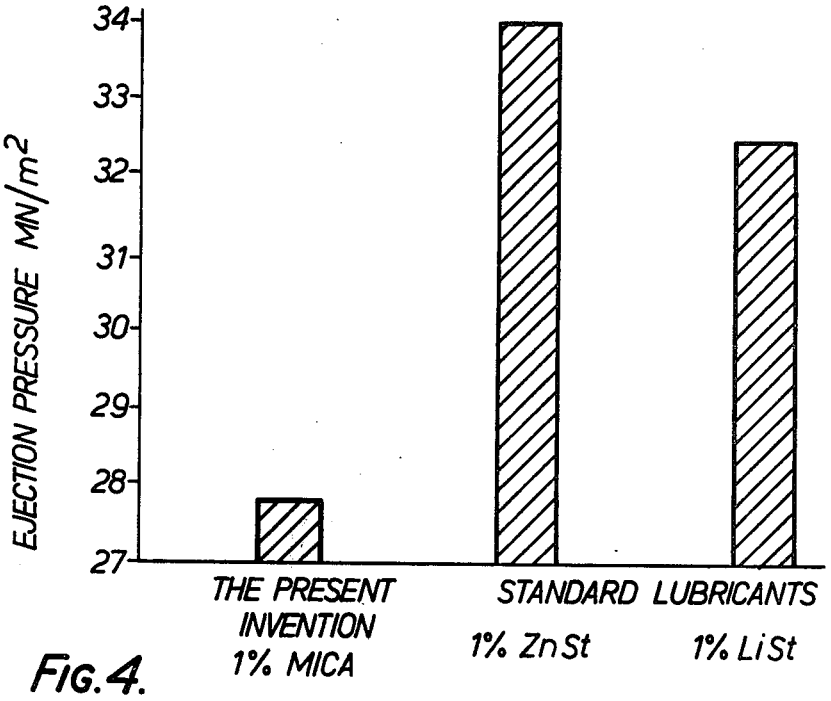
Figure 5:
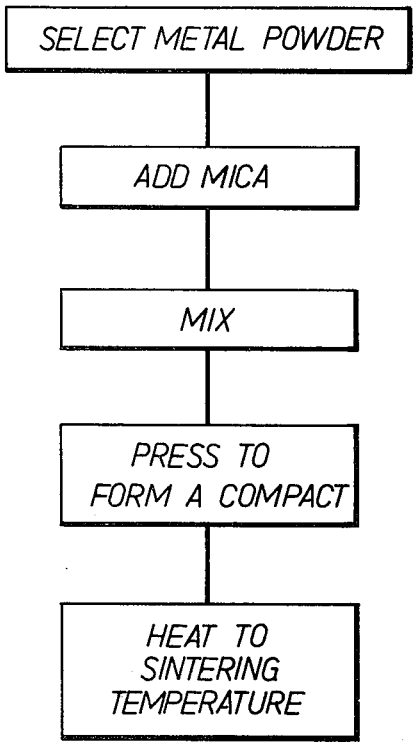

A number of examples of the invention will now be given by way of example with reference to the accompanying drawings, of which:

FIG. 1 is a bar chart showing the green density of preforms using different lubricants when compacted at the same pressure, FIG. 2 is a bar chart showing the compression ratio of the powder using different lubricants when compacted at the same pressure, FIG. 3 is a bar chart showing the compacting pressure required to produce the same green density of the preforms, using different lubricants, FIG. 4 is a bar chart showing the ejection pressure required to eject a green preform from the die, after compaction to a given density using different lubricants, and FIG. 5 is a flow chart illustrating the method.

Powders were selected of less than 100 B.S. mesh size and so as to result in alloys of the percentage compositions given in table:

| Example No. | 1 | 2 | 3 |
|---|---|---|---|
| total carbon | 1 | 0.3 | 2 |

-continued

| Example No. | 1 | 2 | 3 |
|---|---|---|---|
| copper | 6 | 15 | 6 |
| molybdenum | 0.4 | 0.5 | — |
| nickel | — | 1.7 | — |
| chromium | 12 | — | 20 |
| Manganese, silicon, sulphur, phosphorus, titanium, vanadium & cobalt (together in total) | 2.0 max | 2.0 max | 2.0 max |
| iron | bal. | bal. | bal. |
| Sintering temperature °C. | 1100 | 1080 | 1120 |

The metal powders were thoroughly mixed in a mechanical mixer; amounts of muscovite mica powder of less than 300 B.S. mesh size of respectively 0.5%, 1%, 1.5% and 2% were added to samples of each composition, and the mica powder was thoroughly mixed with the metal powder.

The resulting powder was compacted in a suitable powder metallurgy press, the powder being poured into a die of the desired shape and compressed by relative motion of the die and a co-operating tool. Pressures of 309–772 $MN/m^2$ (20–50 $tons/in^2$) were used.

The resulting preforms were readily handled, and were then heated in a furnace to the temperature shown in the table against the metal composition, for periods of 30 minutes in a protective atmosphere, e.g. an atmosphere of cracked ammonia having a dewpoint of less than −30° C., and allowed to cool.

It was found that the mica was unaffected by the temperature or by the atmosphere, and no fumes or reaction products were given off. In fact the mica, being inert, remains in the finished sintered articles.

The green density of the preforms made of the powder of example 1 is shown in FIG. 1; the first column shows that using 1% of mica a density of 6.9 gm/cc was achieved, as compared with the same powder using conventional lubricants, respectively zinc stearate and lithium stearate as shown in the second and third columns, when a density of only 6.58 gm/cc was achieved, using the same compacting pressure of 618 $MN/M^2$ Squared.

FIG. 2 shows that the compression ratio (i.e. the ratio between initial and final volume) of the powder when compacted at 618 $MN/M^2$ Squared was 2.4 using 1% mica as the lubricant, as compared with 2.15 using 1% zinc stearate and 2.13 using 1% lithium stearate.

FIG. 3 shows the compacting pressure required to produce a green density in the compact of the powder of example 1 of 6.6 gm/cc; it will beseen that whereas when using 1% zinc stearate or 1% lithium stearate a pressure of 618 $MN/M^2$ was required, when using 1% mica a pressure of only 386 $MN/M^2$ was needed.

FIG. 4 shows the pressure required to eject a compacted preform from the die after compaction to a density of 6.6 gm/cc; using 1% zinc stearate an ejection pressure of 34.0 $MN/M^2$ Squared was required, and using 1% lithium stearate an ejection pressure of 32.4 $MN/M^2$; but when using 1% mica, an ejection pressure of only 27.8 $MN/M^2$ Squared was needed.

Moreover the reduction of friction improves the uniformity of the density of the preform, and therefore of the final article; it also improves the ability to fill the die completely in the production of complicated shapes, improves the surface finish of the preform, and may increase the life of the tool and die.

It has also been found that the presence of mica in the finished sintered articles confers a degree of selflubricating property, which is valuable when the article is subjected to wear in service, for example as a valve seat insert, without substantially reducing the strength of the article; this is believed to be due to its platelike crystallographic structure. Moreover, since mica is refractory, it is unaffected by exposure in service to air at high temperatures. The finished articles may be piston rings, sealing rings, gearwheels, valve seat inserts, shock absorber pistons, or a variety of products, depending on the shape of the tool and die.

Different varieties of mica, viz: muscovite, phlogopite, and biotite have been found to give very similar results.

We claim:

1. A sintered iron-based metal product suitable for use in wear-resistant applications, and produced by a process comprising:

(a) selecting an iron-based metal powder;

(b) adding powdered mica to the metal powder;

(c) mixing the metal powder and the mica powder;

(d) compacting the resulting mixture; and (e) sintering the compacted powder.

2. A metal product according to claim 1 which contains about 0.5% to 2% by weight of powdered mica.

3. A metal product according to claim 2 wherein the iron-based metal product is a steel.

4. A metal product according to claim 1 wherein the metal product is in the shape of a valve seat insert, piston ring, sealing ring, gear wheel, or a shock absorber piston.

* * * * *